US007988539B2

(12) United States Patent
Palushaj

(10) Patent No.: US 7,988,539 B2
(45) Date of Patent: Aug. 2, 2011

(54) ABRASIVE CLEANING DEVICE

(75) Inventor: Simon Palushaj, Shelby Township, MI (US)

(73) Assignee: Epoxi-Tech, Inc., Madison Heights, MI (US)

( * ) Notice: Subject to any disclaimer, the term of this patent is extended or adjusted under 35 U.S.C. 154(b) by 49 days.

(21) Appl. No.: 11/660,623

(22) PCT Filed: May 20, 2005

(86) PCT No.: PCT/US2005/017849

§ 371 (c)(1),
(2), (4) Date: Feb. 16, 2007

(87) PCT Pub. No.: WO2005/113198

PCT Pub. Date: Dec. 1, 2005

(65) Prior Publication Data

US 2008/0160886 A1 Jul. 3, 2008

(51) Int. Cl.
*B24B 23/00* (2006.01)

(52) U.S. Cl. ..... 451/353; 451/350; 451/490

(58) Field of Classification Search ..... 451/490, 451/350, 353, 358–360, 466, 468
See application file for complete search history.

(56) References Cited

U.S. PATENT DOCUMENTS 3,522,342 A 7/1970 Nungesser et al.
3,605,347 A * 9/1971 Barry ..... 451/463
3,696,563 A 10/1972 Rands
3,871,139 A 3/1975 Rands
4,037,369 A 7/1977 Campbell
4,490,872 A 1/1985 Drumm
4,493,126 A 1/1985 Uy
4,507,361 A 3/1985 Twilley et al.
4,561,214 A 12/1985 Inoue
4,662,044 A 5/1987 Kayabara
5,050,262 A 9/1991 Malish
5,224,231 A 7/1993 Nacar
5,323,505 A 6/1994 Montabaur et al.
5,438,728 A 8/1995 Kubes et al.
5,445,438 A 8/1995 Drumm
5,491,025 A 2/1996 Pihl et al.
5,679,067 A 10/1997 Johnson et al.
5,903,951 A 5/1999 Ionta et al.
5,951,389 A * 9/1999 Hettes et al. ..... 451/508
5,983,434 A 11/1999 Eichinger et al.
6,126,533 A 10/2000 Johnson et al.
(Continued)

FOREIGN PATENT DOCUMENTS

GB 1 262020 2/1972
(Continued)

OTHER PUBLICATIONS

Supplementary European Search Report for EP05752053 dated Oct. 20, 2009.

*Primary Examiner* — Dung Van Nguyen
(74) *Attorney, Agent, or Firm* — Rader, Fishman & Grauer PLLC

(57) ABSTRACT

A cleaning element (36) for a cement floor surface mounted to a housing (32). Each cleaning element has a flat flexible abrasive surface (39) that is transversely positioned to the direction of motion to provide flex during cleaning of a cement floor surface.

18 Claims, 5 Drawing Sheets

U.S. PATENT DOCUMENTS

| | | | |
|---|---|---|---|
| 6,249,928 | B1 | 6/2001 | Wang |
| 6,251,002 | B1 | 6/2001 | Close |
| 6,312,485 | B1 | 11/2001 | Kaiser et al. |
| 6,352,471 | B1 | 3/2002 | Bange et al. |
| 6,422,932 | B1 | 7/2002 | Lageson et al. |
| 6,665,902 | B1 | 12/2003 | Vegter |
| 6,669,746 | B2 | 12/2003 | Nizaki et al. |
| 7,081,047 | B2 | 7/2006 | Palushaj |
| 2002/0094437 | A1 | 7/2002 | Nizaki et al. |
| 2002/0148059 | A1 | 10/2002 | Lin |
| 2002/0182983 | A1 | 12/2002 | Yamamoto et al. |

FOREIGN PATENT DOCUMENTS

| | | | |
|---|---|---|---|
| WO | WO-99/03643 | A1 | 1/1999 |

* cited by examiner

Fig-3
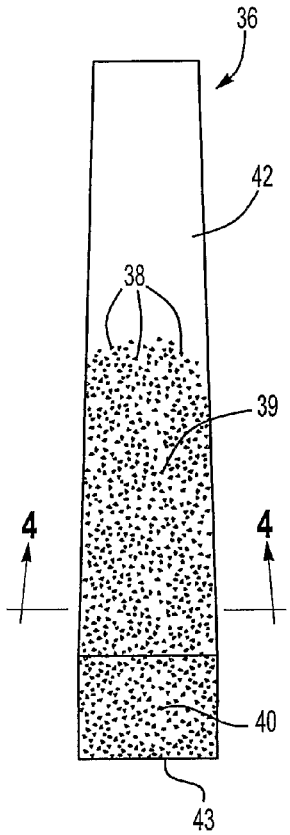
Fig-5
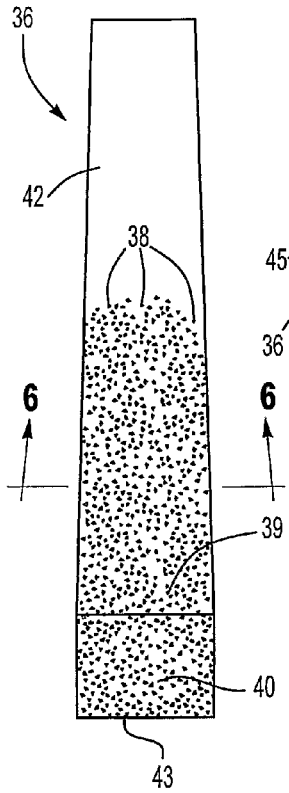
Fig-4
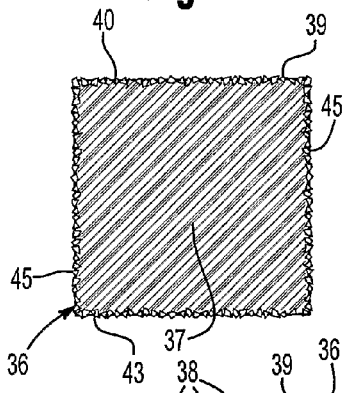
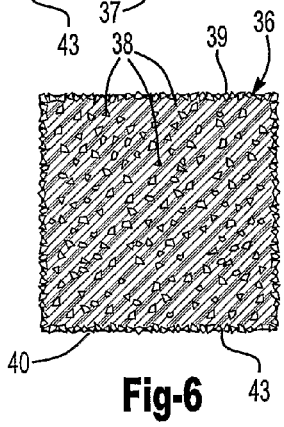
Fig-6
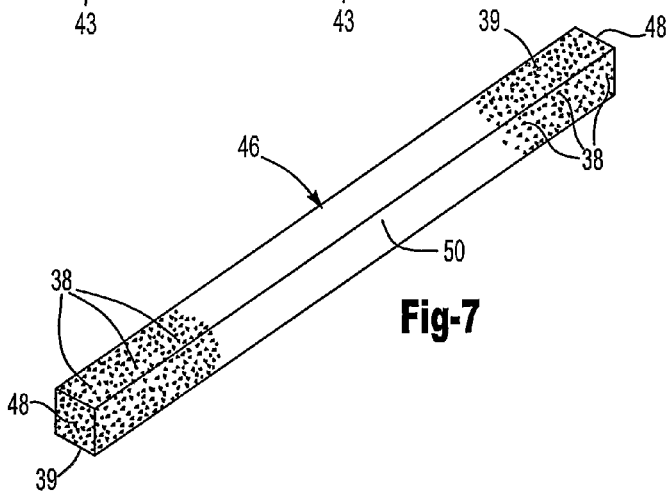
Fig-7

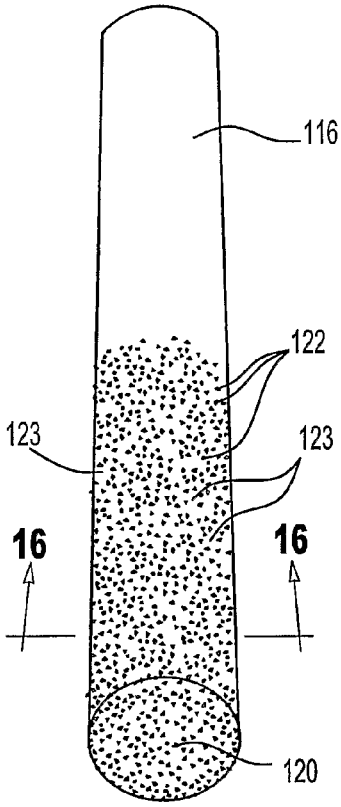
Fig-15
Fig-16
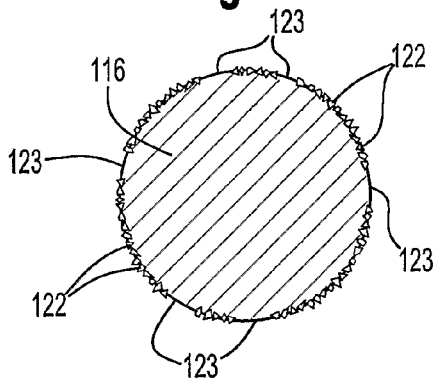
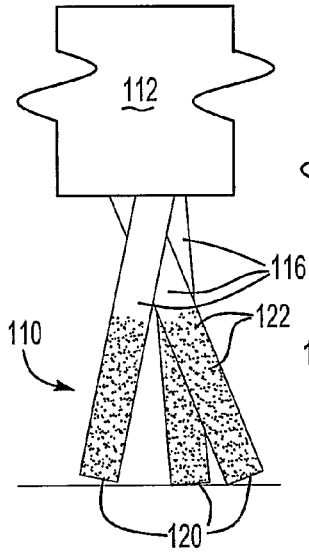
Fig-17
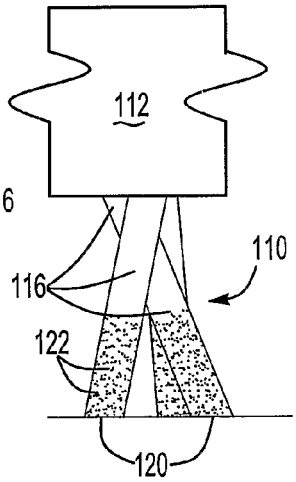
Fig-18
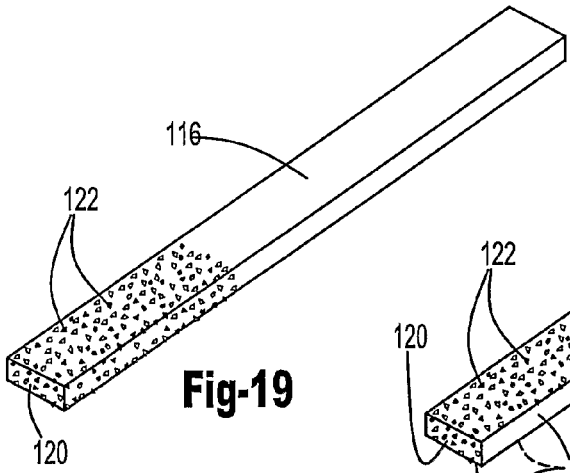
Fig-19
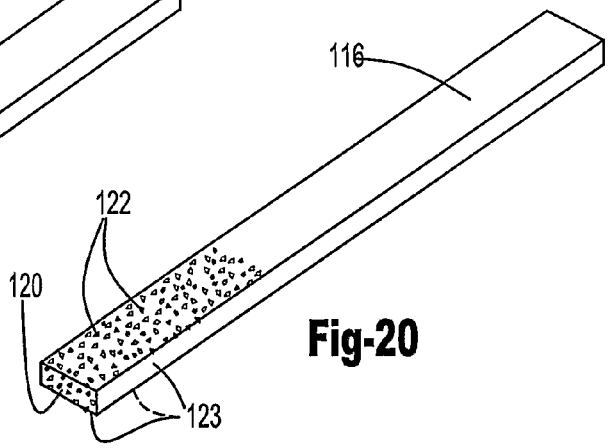
Fig-20

ABRASIVE CLEANING DEVICE

TECHNICAL FIELD

The field of this invention relates to a cleaning device for polished concrete surfaces and a reinforced brush for sanding concrete floors and surfaces.

BACKGROUND OF THE DISCLOSURE

While concrete or cement is a very popular material for use in floors and construction materials because of its strength, durability and low costs, if the concrete or cement is left unfinished, the concrete floor will inherently produce dust by the constant scuffing it undergoes whether by foot traffic or wheeled traffic and be susceptible to staining due to porosity.

One is thus faced with a dilemma of cleaning a concrete floor with its no gloss utilitarian appearance and with the disadvantage of the inevitable dust that emanates from an unfinished concrete floor or spending considerable money for a protective and decorative covering surface. Part of the expense to obtain a decorative and protective covering is due to the preparation of the concrete floor to accept a covering surface. The preparation often includes aggressive sanding to rough up the concrete surface and to remove any top surface or oil and grease stains to assure proper adhesion of the covering. Aggressive sanding of the concrete surface is a time consuming effort requiring frequent replacement of the sand paper as the sand particles become worn.

Attempts for more aggressive sanding and grinding pads have incorporated hardened particles such as diamonds or silicon carbide. While these pads performed well when new, the particle edges become rounded out through wear and the sanding performance substantially diminishes. Other problems are known that also prevent or limit the application of hardened particles. The present application of a bristle made from today's known higher temperature plastic materials when combined with the aforementioned hard abrasive materials generate much heat when used on a high speed power sander. The generated heat is sufficient to melt the plastic material and fuses the bristles together rendering the bristle pad useless. Previous metal bristles, if fully brazed with particles become too brittle and break off during high speed application.

Pads or wide sanding surfaces encounter problems with wavy or uneven concrete surfaces. They have a tendency to miss the low spots. As a result, to reach the low spots, they must remove the high spots which results in extra sanding and effort.

Normal cleaning of concrete whether by a power wash, power sweep or scrub progressively deteriorates concrete by breaking apart smaller particles from the concrete surface, thereby making the concrete surface more porous and more suspect to further deterioration.

Known cleaning brushes also progressively deteriorate concrete surfaces. The small bristles tend to undesirably add porosity to the concrete surface by poking into the holes that naturally occur in the concrete and breaking away the smaller particles of the concrete. One is then faced with a dilemma of cleaning a concrete floor with the disadvantage of the deterioration of its relatively smooth surface.

One way to achieve a better concrete surface look is to add a densifier such as sodium silicate to the concrete floor which closes the porosity of the floor. One then polishes the concrete with successive finer grit sand paper or polishing pads. This known process provides for a relatively attractive concrete polished surface. However this surface also needs maintenance when it gets dirty.

What is needed is a bristle brush for concrete sanding that has an improved performance profile by incorporating hardened particles along a substantial portion of its length which expose new particle edges as the bristle wears down. What is also needed is a more flexible metal bristle with hardened particles secured thereon with the brazed coating applied only where the diamonds are secured onto the bristle to maintain sufficient flexibility of the metal bristles. What is also needed is a flexible bristle that can prepare high and low spots of a concrete surface by better following the contour of the concrete surface.

What is also needed is a durable cleaning brush for mounting to a cleaning or buffing machine that is suitable for cleaning a polished cement floor. What is also needed is an expedient method to clean a polished concrete floor. What is also needed is a bristle that is durable and with a cross-sectional diameter larger than the cement floor pores in order to hone and smooth a concrete floor rather than degrade it during the cleaning process, the same brush can also be used as a durable abrader. What is also needed is a bristle that has a durable abrasive particle securely affixed to the bristle that is capable of honing a concrete surface.

SUMMARY OF THE DISCLOSURE

In accordance with another aspect of the invention, a brush for a power sander for sanding concrete surfaces has a base for mounting onto a power sander and a plurality of bristles depending from the base. It is preferred that the bristles are mounted at varying angles with respect to the base. The bristles have a plurality of hard particles secured along a substantial length of a lower distal half of each bristle such that as the bristle wears down in use, new particle surfaces are exposed at a distal end of the bristles to maintain sanding performance of the brush.

Desirably, the bristles are made from a metal substrate. Preferably, the metal is a steel. The steel can preferably be stainless or carbon steel.

In one embodiment, the particles are diamond particles that are brazed onto the steel with a brazing alloy. The brazing alloy is positioned on the steel only where the diamond particles are brazed with areas of the steel free of brazing alloy interspersed between brazed areas to retain flexibility of the steel bristle.

In accordance with another aspect of the invention, a brush bristle for a power sander brush for sanding concrete has a wearable bristle substrate and a plurality of hard particles secured along a substantial length of the wearable bristle substrate such that as the bristle wears down during use, new particle surfaces are exposed at a distal end of the bristle to maintain sanding performance of the bristle.

In accordance with another aspect of the invention, a sanding brush for a power sander includes a base with a quick connect fitting for mounting to a power sander and a plurality of metal bristles mounted a different angles having respective distal ends all generally near the same horizontal plane. The plurality of bristles have diamond particles brazed thereon along a distal half. The bristles having a circular cross-sectional shape with a diameter being no greater than approximately ⅛ inch.

In accordance with another aspect of the invention, a bristle for power sanding has a metal substrate with hard abrasive particles brazed onto the metal substrate with a brazing material. The brazing material is positioned only where the particles are brazed onto the metal substrate with areas of the metal substrate free of brazing material being interspersed between the brazed areas to retain flexibility of the metal substrate.

In accordance with another aspect of the invention, an abrasive cleaning device has a housing and a plurality of cleaning strips having a front abrasive face with a width and length. The cleaning strips are mounted to the housing such that the front abrasive face is aligned substantially transverse to the normal direction of motion of the housing. The cleaning strips include an abrasive material at the surface of the cleaning strips and secured to a substrate of the strips. The length of the face is substantially greater than the thickness of the strip to provide flexibility of the cleaning strips.

In accordance with another aspect of the invention, an abrasive cleaning device has a plurality of cleaning strips with one end mounted to the housing. The strip has a distal end with an abrasive material at the surface of a substrate and secured to the substrate. The length of the cleaning strips is substantially greater than its thickness to provide resilient flexibility. Preferably the substrate is made from a steel or plastic that provides the resilient flexibility to the bristle. Preferably, abrasive particles are secured to the strip such that when the strip wears it is exposing fresh abrasive particles at its working scrub surface. The distal working surface provides a flat edge to scrape away dirt and residue while the sharp abrasive particle cut and hone the cement surface. As the abrasive particles wear out, i.e. round down and loose its effectiveness, they eventually abrade away as the bristle shortens to expose new abrasive particles to the work surface.

In one embodiment, the abrasive material is formed by hard abrasive particles being embedded in the substrate that is a high temperature plastic matrix. In one embodiment, the housing is in the form of a rotatable pad made for rotation about a central point. The cleaning strips have their respective front faces substantially radially aligned with the center of the pad. In another embodiment, the housing is tubular and made for rotation about its major axis. The cleaning strips extend radially from the housing with the faces co-aligned with the major axis.

In accordance with another aspect of the invention, an abrasive bristle includes a plastic matrix, and an abrasive material embedded in a distal end section of the bristle. A proximate mounting section of the bristle is devoid of the abrasive material.

In one embodiment, the distal end with the abrasive material extends toward the proximate mounting section with the abrasive ending at a point where the flexibility degrades a sufficient amount and the point being used as a wear indicator. In one embodiment, the abrasive material includes diamond particles. In one embodiment, the bristle includes abrasive material at opposing distal ends of the bristle element with a middle section being a mounting section to a support base. The middle section is devoid of the abrasive material. It is preferred that the abrasive material is embedded in the plastic matrix. It is also preferred that the plastic matrix is a high temperature plastic material.

In another embodiment, the abrasive is coated on opposing ends. Preferably, the abrasive is brazed on the opposing ends.

In accordance with another aspect of the invention, a method of claiming a polished concrete surface includes moving a plurality of cleaning strips having a front abrasive face aligned substantially transverse to the direction of movement. The cleaning strips resiliently flex to accommodate high and low spots of the concrete surface. Preferably, the cleaning strip is in the form of a flexible plastic matrix with the abrasive face having a plurality of abrasive particle secured onto the cleaning strip across the face.

Preferably, the cleaning strips in cross-section have a major axis and a minor axis with the major axis positioned to be transverse to the normal motion of the housing. It is also preferred that the housing is a rotatable pad made for rotation about a central point. The cleaning strips have their respective major axis substantially radially aligned with the center of the pad. In one embodiment, the abrasive material is diamond particles being brazed onto the substrate which can be steel.

According to another aspect of the inventor, the flexible bristles with abrasive particles have a cross-sectional diameter substantially greater than the cement pores and preferably greater than ⅛" diameter to provide the bristles to glide over the pores and clean and hone the surface of the polished cement.

BRIEF DESCRIPTION OF THE DRAWINGS

Reference now is made to the accompanying drawings in which:

FIG. 3 is an enlarged perspective view of one cleaning element made in accordance with another embodiment of the invention;

FIG. 4 is a cross sectional view taken along lines 4-4 shown in FIG. 3;

FIG. 5 is an enlarged perspective view of a further modified embodiment of a cleaning element;

FIG. 6 is a cross sectional view taken along lines 6-6 shown in FIG. 5;

FIG. 7 is an enlarged perspective view of an additional embodiment of a cleaning element;

FIG. 15 is an enlarged perspective view of one bristle shown in FIG. 13;

FIG. 16 is a cross-sectional view taken along lines 16-16 shown in FIG. 15;

FIG. 17 is an enlarged illustrative view of some bristles in operation when the brush is new;

FIG. 18 is a view similar to FIG. 17 illustrating use of the brush near the end of its useful life; and FIG. 19 is a perspective view of a modified bristle.

FIG. 20 is a perspective view of an alternately configured bristles.

DETAILED DESCRIPTION OF THE PREFERRED EMBODIMENT

Figure 1:
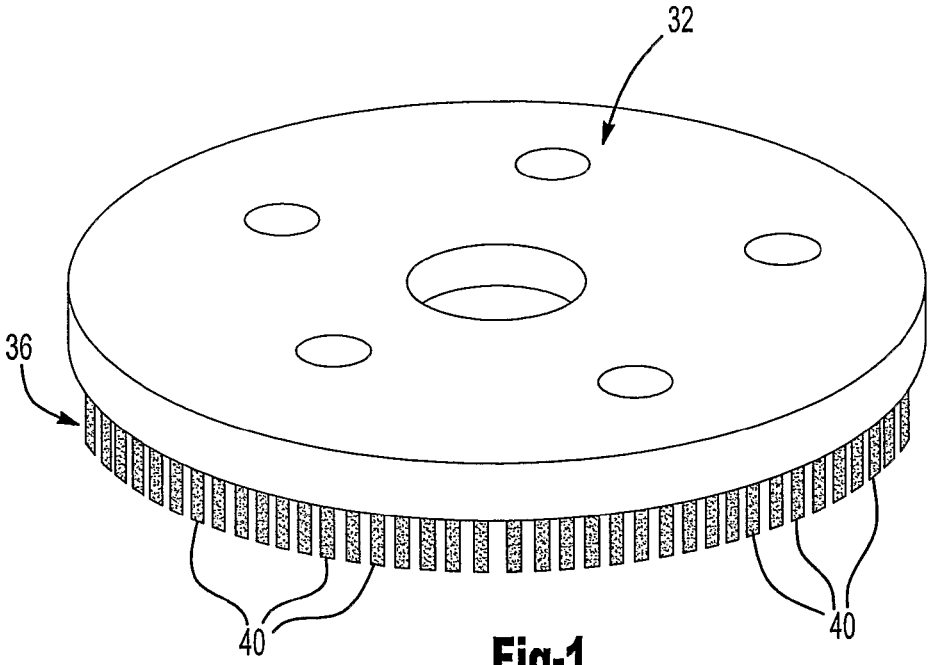
FIG. 1 is a perspective view of a high speed burnishing brush with a cleaning device incorporating one embodiment of the invention.
Figure 10:
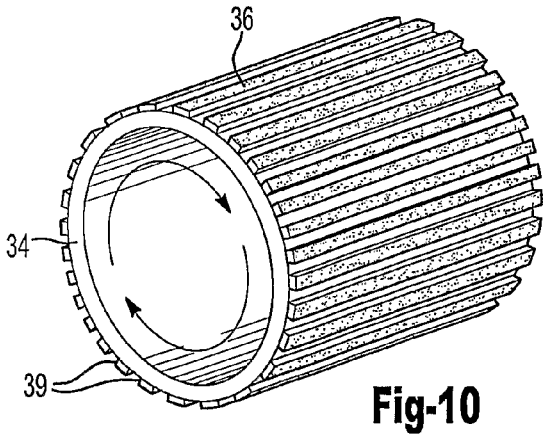
FIG. 10 is a perspective view of a roller brush incorporating blades in accordance with an alternative embodiment of the invention.

Instead of washing and waxing as is often done with conventional floors, the maintenance of a polished concrete floor is accomplished by using an abrasive pad 32 used as shown in FIG. 1 on a conventional high speed machine (not shown). The machine is set at about 175 rpm's with a pad pressure of 60-300 psi. The cleaning can also be done by a drum brush 34 as shown in FIG. 10 also mounted to a conventional drum machine (not shown).

Figure 2:
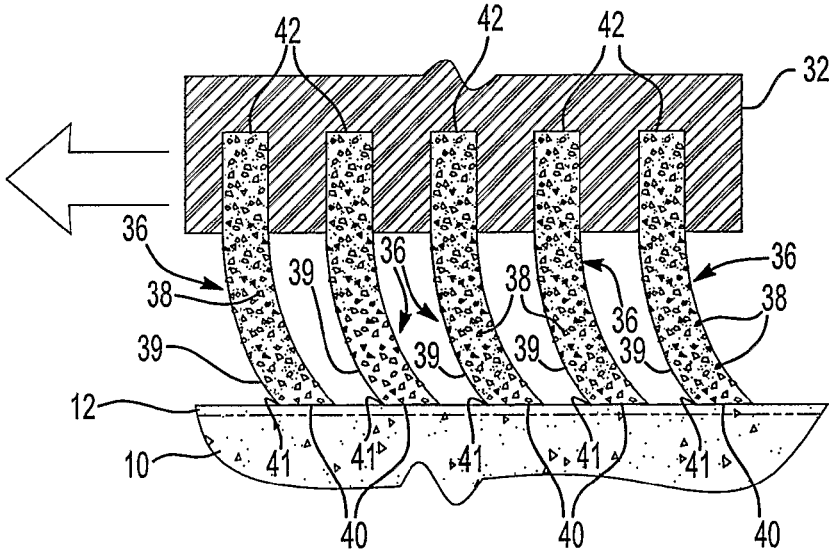
FIG. 2 is an enlarged side elevational view of the cleaning device on the polished concrete floor.

The pad 32 is made from a plurality of cleaning elements called strips or bristles 36 which can be in the form of a round, square or rectangular bristle as shown in FIG. 2 which can be embedded with abrasive 38. The bristle 36 may be extruded from a high temperatures thermoplastic material mixed with abrasive particles 38. The abrasive particles 38 may be a hard particulate such as alumina silicate or small industrial diamond particles.

In one embodiment as shown in FIGS. 3 and 4, the bristle 36 has a distal end 40 with an abrasive flat front face 39 that engages the polished floor 10 with the hardened abrasive particles. The abrasive particles are sufficiently aggressive to scour any dirt or grime that exists on the concrete floor. The square bristles are at least ⅛ inch wide to be larger than the pores of most normal concrete floors. While a square bristle is shown, rectangular or other shaped bristles are possible as long as they have a scrub face 39 over ⅛ inch wide.

Figure 9:
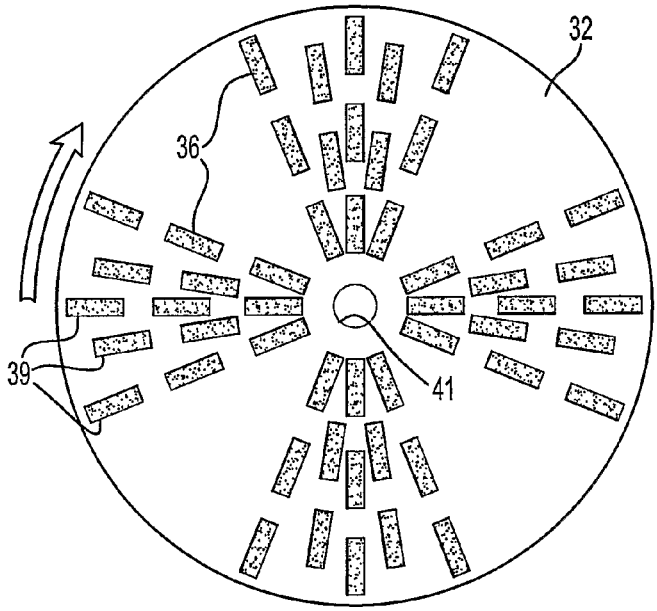
FIG. 9 is a bottom plan view of a disc pad incorporating wide blade shaped strips in accordance with an alternative embodiment of the invention.

The bristle has its mounted end 42 embedded in the pad as shown in FIGS. 1 and 2 by being molded directly therein. The bristles are mounted such that the abrasive scrub face 39 is aligned transverse to the normal direction of motion of the pad at the face 39. For example, as shown in FIG. 9, the faces 39 are radially aligned about the center 41 of the pad when the pad rotates about its center 41. The drum brush shown in FIG. 10 has the faces aligned along the width of the drum brush such that as the drum rotates in the indicated direction, the face 39 flushly encounters the concrete floor.

Figure 12:
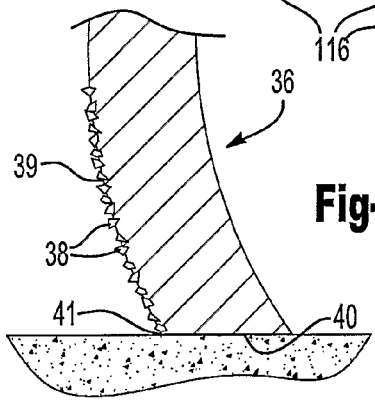
FIG. 12 is a view similar to FIG. 11 showing the abrasive particles only on the lower section of the front sanding surface.

When diamond particles 38 are embedded as abrasive in the bristle, it is desirable that only the working distal end 40 is provided with the diamond particles 38 to contain costs of the relatively expensive diamond particles. As shown in FIGS. 3-6, two embodiments are shown each with diamond abrasive in proximity with the distal end 40 and the proximate mounting end 42 being devoid of such diamond particles. The embodiment shown in FIGS. 3 and 4 show a bristle with a layer of diamond particulates coated about the distal end. The diamond particulates are coated sufficiently thick and are secured strong enough to maintain its adherence to the underlying bristle material. It should be noted that only the scrub surface 39 needs to be coated. As shown, opposing surface 43 is also coated in case there are machines that rotate the pad in the opposite direction. The side walls 45 need not have any abrasive coating. FIG. 12 illustrates an embodiment where only the front scrub surface 39 has an abrasive coating and side walls 45 and opposing surface 43 are free of an abrasive coating.

FIGS. 5 and 6 show where the extruded bristle is made such that only the distal area 40 has the diamond particulate embedded therein with the remaining or proximate section 42 being devoid of diamond particulate. In this embodiment, the embedded diamonds extend completely through the interior of the bristle 36 as clearly illustrated in cross sectional view of FIG. 6. This embedded particulate has its advantages over the embodiment shown in FIGS. 3 and 4 as the bristle abrades through extended use, its outer surface at the distal end 40 no matter how worn always provides an outer abrasive surface 39 with diamond particulate 38 on a working surface.

For either embodiment, as the pad 32 is used, the distal end 40 abrades to provide a straight knife-like edge 41 on the concrete surface 12. As the diamond particles 39 wear down and their effectiveness becomes diminished, they eventually abrade off the bristle as the substrate material whether plastic or steel also wears down to provide a fresh diamond particles just above to replenish the effectiveness of the bristle.

In this fashion an abrasive bristle maintains its abrasive aggressiveness for a long term. The resilient flexibility of the bristle provides relief when the pad hits a high spot of the concrete floor and will not gouge at the high spot or opens the pores at the high spot.

Furthermore, the bristles 36 have a length that is sufficiently long compared to its thickness to provide resilient flexibility of the bristle as illustrated in FIG. 2 to flex. As the bristle is shortened through the extended wear and the bristle becomes to short and too stiff for proper use, the diamond particulate also becomes exhausted which provides for a sensory indicator that the bush is worn out.

In this manner, the brush by having a bristle with a relatively wide, flat, and resilient flexible abrasive face 39 does not cause excessive deterioration of the concrete floor. In fact, it hones the concrete floor to maintain its smoothness. Secondly, by only having diamond particulate at the distal section 40, there is less waste of diamond particulate. In addition, a sensory wear indicator is provided when the diamond particulate is totally abraded.

Figure 8:
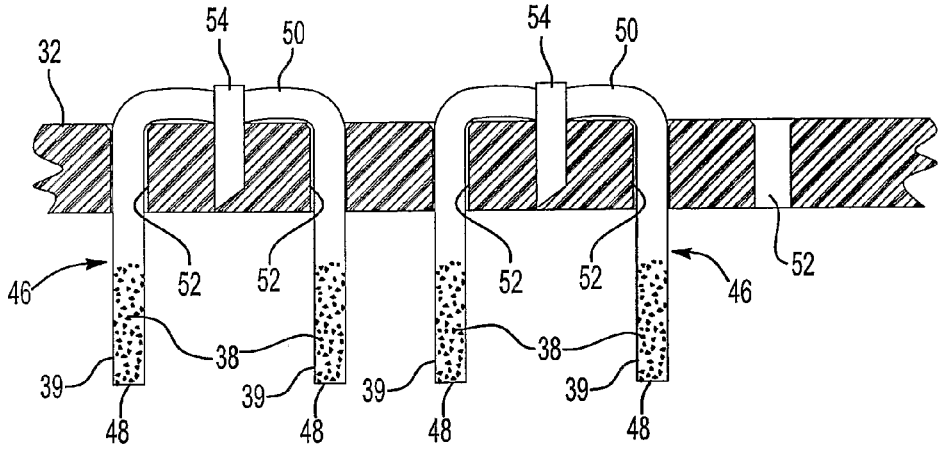
FIG. 8 illustrates a method of attaching the bristle shown in FIG. 7 to a housing.

A further embodiment is shown in FIGS. 7 and 8 which provides for a double ended bristle 46 that has two opposing distal ends 48 each with diamond particulate either coated or embedded in the same fashion as described in the embodiments shown and described for FIG. 3-6.

In this bristle, both distal ends 48 are positioned to be operable against the floor surface 10. The mid-section 50 is mounted to the brush substrate by extending through holes 52 and being stapled in place by staple 54. Other molding techniques may also embed the mid-section 50 in the brush with the two distal ends 48 extending outward. It should be noted that the bristle provides for two cleaning sections with opposing abrasive faces 39. When the bristle is mounted into the pad, both faces 39 face the same direction. The operation of the brush bristles 46 is identical with the previous described embodiments.

While square cross-sectioned bristles 36 have been shown and described, wide blade bristles 36 as shown in FIG. 9 can be used with pad 32. Bristles 36 have a cross-section with a major and minor axis with the major axis being radially aligned about the center of rotation 41 and transverse to the normal motion of pad 32. The blade shaped bristles 36 while shown in four staggered sections can have a variety of configurations on pad 32. The bristles 36 may also have an elliptical or oblong cross-sectional shape with the major axis in the same position as shown. A bristle with a circular cross-section is also usable for honing the concrete surface if the diameter exceeds ⅛".

Figure 11:
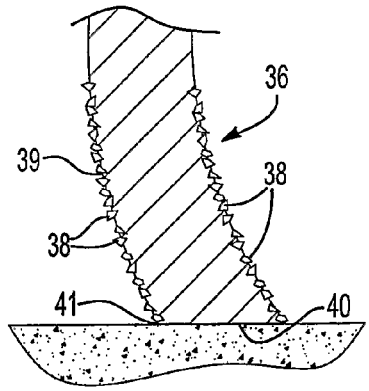
FIG. 11 is a cross-section side elevational view of a steel bristle with diamond abrasive particles brazed thereon in use on a concrete floor.

While a plastic matrix has been shown and described, the substrate may be made from steel such as steel wire or wire strips 36 as shown in FIG. 11 with diamond particles 38 brazed or electroplated thereon.

Another embodiment is shown in FIG. 10 with drum 34 mounting wide blades 36 about its periphery to provide scrub faces 39 to operate in similar fashion as described before. The brush may also be used as an aggressive abrader. For this use, narrower bristles may also be used.

Figure 13:
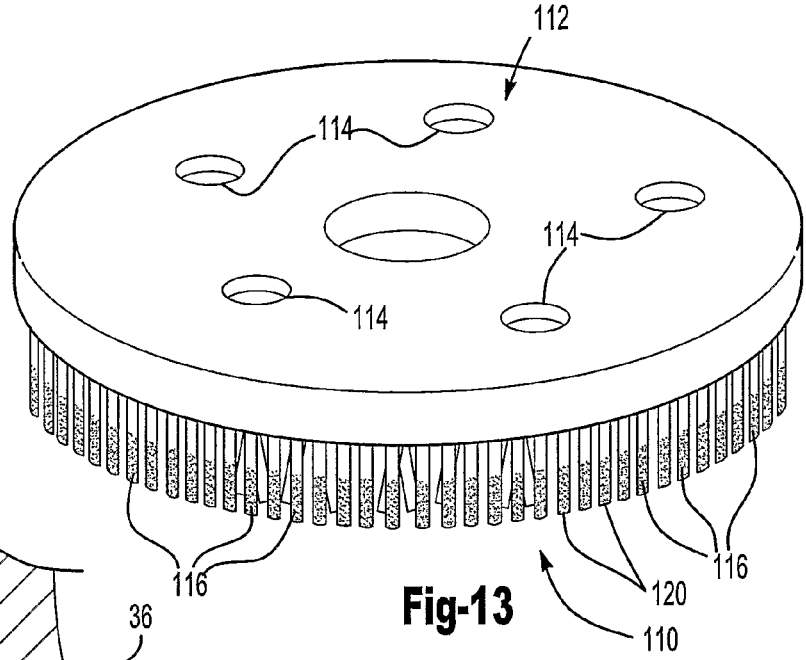
FIG. 13 is a perspective view of a bristle brush in accordance with one embodiment of the invention.
Figure 14:
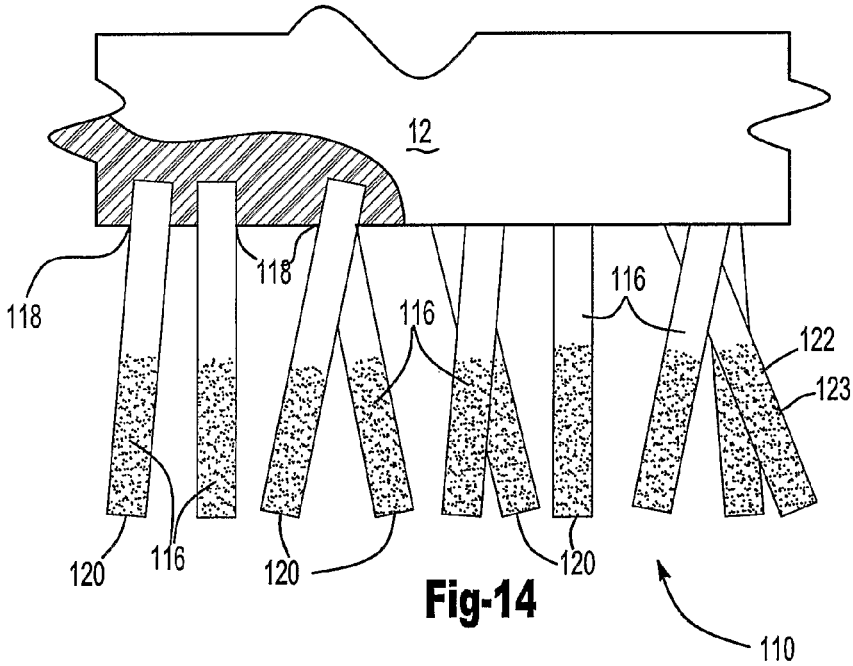
FIG. 14 is an enlarged fragmentary side view of the brush shown in FIG. 13.

Referring now to FIG. 13, an abrasive brush 110 for use on a conventional high speed power sanding machine (not shown), has a base 112 that has conventional quick connect fittings 114 in the form of apertures which removably snap fit onto conventional studs (not shown) on the sander. The base which can be made from a plastic material mounts a proximate end 118 of a plurality of bristles 116 extending from the base 112. The bristles 16 may be arranged in a generally vertical direction as shown in FIG. 13. Preferably as clearly shown in FIGS. 14, 17-18, the bristles extend downwardly at differing angles. Whatever the angle, each bristle preferably has its distal end 120 generally or nearly coplanar with the other distal ends as more clearly shown in FIG. 14.

Reference now is made to FIGS. 15 and 16 where the bristle 116 is shown to have a plurality of diamond particles 122 brazed or otherwise secured onto the surface of the bristle from its distal end and extending at least halfway up the distal end, i.e. about one quarter of the length of each bristle. For manufacturing ease, the diamond particles may extend along the entire length of the each bristle. Depending on the specific application, gage of the bristle and flexibility desired for a specific sanding application, the diamond particles need to extend up to the wear point i.e. useful length of the bristle before the bristle brush is replaced.

The diamond grit may vary but it is foreseen that a grit of 70 is useful for many sanding applications for concrete floors. Other particulates may be substituted for the diamond particles, for example alumina silicate or silicon carbide. The bristle 116 preferably has a round cross section as shown in FIG. 16. The distal portion of the bristles has the brazed diamonds thereon. For example, if the bristle is 2 inches long, the distal one inch has the diamonds with no diamonds or braze above the midpoint. Other variations are foreseen such as a substantial portion of the distal half being covered by diamond particles or a substantial portion of the entire length of the bristle may have diamonds brazed thereon.

In one embodiment, the bristles may be made from stainless or carbon steel having a diameter of less than one millimeter up to one-eighth inch. The diamonds of 70 grit may be in a brazing alloy nickel slurry and sprayed onto the bristle with the brazing then being set with the diamonds secured in place. In this way, the bristle surface has the diamond particles 122 secured thereon with bristles areas 123 interspersed without diamonds or brazing materials. The presence of interspersed areas 123 retain flexibility of the steel bristle. If the entire bristle was saturated with brazing alloy, the bristles would become too brittle for the concrete sanding application.

Other ways are also foreseen, to provide areas 123 of different shapes. The particles can be spot brazed such as in stripes spots, or spirals to maintain interspersed areas 123 of steel bristle with no alloy thereon. As shown in FIGS. 12 and 20, only the front scrub surface may have abrasive thereon with brazing alloy.

During use, the bristle 116 when new has its distal end 120 sand the concrete surface. It is found that the sharp edges of the diamond particles is sufficiently aggressive to sand the concrete surface and remove paint or other previously applied materials. The concrete floor quickly achieves a scratched surface in accordance with the grit sized used. The bristles do not clog with paint or smear any previously applied material such as paint or oil.

In contrast to plugs or other wide diamond impregnated prepping tools, the metal brush as it scours over the concrete with a power machine to force a pad pressure of 60-300 P.S.I. will gradually have its substrate wear away. When sufficient wear occurs to the bristle, the worn diamond particles 122 at the distal end will shed off the bristle to expose new sharp edges of other diamond particles 122 further up on the bristle. This wearing will continuously occur until sufficient amount of the bristle will wear away as shown in FIG. 18. Due to the introduction of new sharp edged diamond particles, the performance or aggressiveness of the bristles in FIG. 18 near the end of its useful life remains quite high relative to the performance of the bristles shown in FIG. 17 when the pad is new. The aggressiveness of the bristle pad remains high like a new pad. The needed flexibility of the bristles during sanding is retained by the flexible steel, metal or other substrate of the bristles. The flexible bristles allow the brush to reach low sections of an uneven floor without excessive removal from high sections.

While a round bristle is foreseen for most applications, a bristle with a generally rectangular i.e. flat contour can be used as shown in FIG. 19. Other modifications are possible, for example a roller with radially extending bristles for use with a drum sanding machine is also foreseen. It is also foreseen that high temperature plastics that can withstand the temperatures developed by a high speed power floor sander may be substituted for the metal substrate.

In this fashion the use of diamond abrasive bristles becomes cost effective and provides for easy maintenance of a polished concrete or cement floor surface and provide honing of the floor during cleaning maintenance.

In this fashion, an aggressive abrader that can prepare concrete surfaces for application of a surface coating is provided that can abrade at multiple times faster than previous known plugs and sanding pads. The flexible bristles can follow the contour of a wavy or uneven floor surface to adequately prepare low sections or valleys of the concrete surface. The low section can be reached and sanded without extra removal from the high sections of the concrete surface. Hence, an uneven floor surface can be prepared for a coating more expeditiously and evenly.

Other variations and modifications are possible without departing from the scope and spirit of the present invention as defined by the appended claims.

The embodiments in which an exclusive property or privilege is claimed are defined as follows:

1. An abrasive cleaning device comprising:

a housing; and a plurality of cleaning strips each having a proximal end attached to the housing, a distal end remote from the housing, and a flat front abrasive face with a width and a length on the distal end of the cleaning strip, said cleaning strips arranged on said housing such that said front abrasive face is displaced away from each adjacent cleaning strip;

said cleaning strips being mounted to said housing such that the front abrasive face is aligned substantially transverse to a normal direction of motion of said housing;

said cleaning strips having a substrate and a plurality of abrasive particles embedded on an external surface of said substrate, with an interior region of said substrate being substantially free of said abrasive particles; and the length of said cleaning strips being substantially greater than a thickness of said cleaning strips to provide flexibility to said cleaning strips.

2. An abrasive cleaning device as defined in claim 1 further comprising:

said abrasive particles being disposed generally at the surface of only the distal end of the cleaning strip.

3. An abrasive cleaning device as defined in claim 1, wherein said abrasive particles are only embedded in said front abrasive face.

4. An abrasive cleaning device as defined in claim 1, wherein said front abrasive face is aligned substantially perpendicular to said normal direction of motion of said housing.

5. An abrasive cleaning device as defined in claim 1, wherein said cleaning strips in cross-section include a major axis extending substantially parallel to said width of said cleaning strips, and a minor axis extending substantially parallel to said thickness of said cleaning strip, with said major axis being positioned transversely to a normal motion of said housing.

6. An abrasive cleaning device as defined in claim 5, wherein said major axis is aligned substantially perpendicular to said normal direction of motion of said housing.

7. An abrasive cleaning device as defined in claim 1, wherein said width and said thickness of said cleaning strip are substantially equal.

8. An abrasive cleaning device as defined in claim 1, wherein said cleaning strips include a substantially rectangular cross-section.

9. An abrasive cleaning device as defined in claim 1, wherein said cleaning strips include a substantially square cross-section.

10. An abrasive cleaning device as defined in claim 1, wherein no portion of a cleaning strip contacts an adjacent cleaning strip.

11. An abrasive cleaning device as defined in claim 1, wherein a longitudinal axis of said cleaning strips is aligned substantially perpendicular to a plane of rotation of said housing.

12. An abrasive cleaning device comprising:

a housing;

a plurality of cleaning strips each having a proximal end attached to the housing, a distal end remote from the housing, and a flat front abrasive face with a width and a length on the distal end of the cleaning strip;

said cleaning strips being mounted to said housing such that the front abrasive face is aligned substantially transverse to a normal direction of motion of said housing;

said cleaning strips having a substrate and a plurality of abrasive particles embedded on an external surface of said substrate, with an interior region of said substrate being substantially free of said abrasive particles;

the length of said cleaning strips being substantially greater than the thickness of said cleaning strips to provide flexibility to said cleaning strips;

said housing being tubular and made for rotation about its major axis; and said cleaning strips extend radially outward from said housing with said abrasive faces substantially co-aligned with the major axis.

13. An abrasive cleaning device comprising:

a housing;

a plurality of cleaning strips having a substrate with a mounting end mounted to said housing and a distal end with an abrasive material at the surface of said substrate and secured to said substrate;

said cleaning strips having a length extending outward from said housing, a width and a thickness, said width being greater than said thickness and said length being substantially greater than said thickness to provide flexibility of said cleaning strips;

said cleaning strips in cross-section having a major axis extending substantially parallel to said width of said cleaning strips, and a minor axis extending substantially parallel to said thickness of said cleaning strip, with said major axis being positioned transversely to a normal motion of said housing;

said housing being a rotatable pad made for rotation about a central point; and said cleaning strips having their respective major axis substantially radially aligned with the center point of said pad.

14. An abrasive cleaning device as defined in claim 13 further comprising:

each said cleaning strip having at least one front abrasive face;

said abrasive material at the surface of only the front abrasive faces.

15. A brush for a power sander for sanding concrete surfaces, said brush comprising:

a base for mounting onto a power sander;

a plurality of bristles extending from said base, said bristles engaging said base at an oblique angle and having a distal portion remote from said base terminating in a distal end, said bristles including a flat front abrasive surface arranged on said distal portion of said bristles, said bristles being mounted at varying angles with respect to said base and the front abrasive surface aligned substantially transverse to a normal direction of motion of said base; and said bristles having a plurality of hard particles generally affixed only to the bristles and not to the base, said hard particles being secured along a substantial length of the distal portion of said bristle such that as said bristle wears down in use, new particle surfaces are exposed at the distal end of said bristle to maintain sanding performance of the brush.

16. A brush as defined in claim 15, wherein said hard particles being at the surface of only the front abrasive face of said bristles.

17. A brush as defined in claim 16 further comprising:

said bristles being made of metal; and said hard particles including diamond particles brazed onto said metal.

18. A brush as defined in claim 17 wherein a brazing alloy is positioned on said metal only where said diamond particles are brazed with areas of said metal free of brazing alloy interspersed between brazed areas to retain flexibility of said metal bristle.

* * * * *